US009752411B2

(12) United States Patent
Adam

(10) Patent No.: US 9,752,411 B2
(45) Date of Patent: Sep. 5, 2017

(54) DOWNHOLE ACTIVATION ASSEMBLY WITH SLEEVE VALVE AND METHOD OF USING SAME

(71) Applicant: National Oilwell DHT, L.P., Houston, TX (US)

(72) Inventor: Mark Adam, Houston, TX (US)

(73) Assignee: NATIONAL OILWELL DHT, L.P., Houston, TX (US)

( * ) Notice: Subject to any disclaimer, the term of this patent is extended or adjusted under 35 U.S.C. 154(b) by 507 days.

(21) Appl. No.: 14/341,634

(22) Filed: Jul. 25, 2014

(65) Prior Publication Data

US 2015/0027725 A1 Jan. 29, 2015

Related U.S. Application Data

(60) Provisional application No. 61/859,012, filed on Jul. 26, 2013.

(51) Int. Cl.

| | |
|---|---|
| ***E21B 34/00*** | (2006.01) |
| ***E21B 34/16*** | (2006.01) |
| ***E21B 34/14*** | (2006.01) |

(52) U.S. Cl.

CPC ..... *E21B 34/14* (2013.01); *E21B 2034/002* (2013.01); *E21B 2034/007* (2013.01)

(58) Field of Classification Search

CPC .. E21B 34/14; E21B 2034/007; E21B 23/006; E21B 34/12; E21B 23/004; E21B 33/068

See application file for complete search history.

(56) References Cited

U.S. PATENT DOCUMENTS

| | | | |
|---|---|---|---|
| 904,344 | A | 11/1908 | Mapes |
| 1,302,058 | A | 4/1919 | Layne et al. |
| 1,391,626 | A | 9/1921 | Oilthorpe et al. |
| 1,485,642 | A | 4/1922 | Stone |
| 1,810,201 | A | 12/1928 | Campbell |
| 1,902,174 | A | 3/1933 | Lewis et al. |
| 2,122,863 | A | 7/1938 | Howard et al. |

(Continued)

FOREIGN PATENT DOCUMENTS

| | | |
|---|---|---|
| CA | 2869793 | 10/2014 |
| WO | 2010127457 | 11/2010 |

OTHER PUBLICATIONS

Examination Report for Canadian Patent Application No. 5,857,841 dated Dec. 4, 2015, 4 pages.

*Primary Examiner* — Daniel P Stephenson
(74) *Attorney, Agent, or Firm* — Conley Rose, P.C.

(57) ABSTRACT

A downhole activation assembly includes a housing that is operatively connectable to a downhole tool and that has a passage for flow of fluid therethrough. An indexing assembly is positionable in the housing, includes a multiple position indexer and an indexing tube, and is operatively connectable to the downhole tool. A sleeve valve includes a fixed sleeve portion and a movable sleeve portion that is positionable in the housing passage and defines a ball passage therethrough. A valve seat in the sleeve valve is configured to receive the ball such that the flow of the fluid is selectively restricted through the ball passage. The movable sleeve is engagable with the indexing tube to selectively shift the indexer between multiple positions whereby the downhole tool is selectively activatable.

23 Claims, 8 Drawing Sheets

(56) References Cited

U.S. PATENT DOCUMENTS 2,179,010 A 11/1939 Creighton et al.
2,890,022 A 6/1959 Brown, Jr.
2,907,589 A 10/1959 Knox
3,376,942 A 4/1968 Van Winkle
3,429,387 A 2/1969 Brown
3,431,989 A 3/1969 Waterman et al.
3,433,313 A 3/1969 Brown
3,451,263 A 6/1969 Richter, Jr. et al.
4,031,974 A 6/1977 Peterson
4,263,939 A 4/1981 Bird
4,319,648 A 3/1982 Cherrington
4,456,063 A 6/1984 Roche
4,537,250 A 8/1985 Troxell, Jr.
4,566,494 A 1/1986 Roche
4,878,549 A 11/1989 Bennet
4,889,197 A 12/1989 Boe
4,905,775 A 3/1990 Warren et al.
4,915,172 A 4/1990 Donovan et al.
4,969,528 A 11/1990 Jurgens
5,141,062 A 8/1992 Anderson
5,217,073 A 6/1993 Bruns
5,303,743 A 4/1994 Vincent
5,348,101 A 9/1994 Boe
5,368,114 A 11/1994 Tandberg et al.
6,006,844 A 12/1999 Puymbroeck et al.
6,155,350 A * 12/2000 Melenyzer ..... E21B 34/063 166/317
6,279,670 B1 8/2001 Eddison et al.
6,439,318 B1 8/2002 Eddison et al.
6,508,317 B2 1/2003 Eddison et al.
6,681,860 B1 * 1/2004 Yokley ..... E21B 23/01 166/208
6,732,817 B2 5/2004 Dewey et al.
7,152,702 B1 12/2006 Bhome et al.
7,252,163 B2 8/2007 Ollerenshaw et al.
7,493,971 B2 2/2009 Nevlud et al.
7,584,811 B2 9/2009 Fanuel et al.
7,658,241 B2 2/2010 Lassoie et al.
7,681,666 B2 3/2010 Radford et al.
7,703,553 B2 4/2010 Eddison et al.
7,757,787 B2 7/2010 Mackay et al.
7,823,663 B2 11/2010 Eddison
7,921,922 B2 * 4/2011 Darnell ..... E21B 23/04 166/168
8,215,418 B2 7/2012 Radford
8,230,951 B2 7/2012 Radford et al.
8,540,035 B2 9/2013 Xu et al.
8,555,983 B2 10/2013 Palacios
2003/0111236 A1 6/2003 Serafin
2005/0284525 A1 12/2005 Schnell et al.
2006/0144623 A1 7/2006 Ollerensaw et al.
2006/0162935 A1 7/2006 MacDougall
2007/0089912 A1 4/2007 Eddison et al.
2007/0102201 A1 5/2007 Savignat
2007/0240906 A1 10/2007 Hill
2007/0261886 A1 11/2007 Wilson et al.
2008/0070038 A1 3/2008 Vincent et al.
2008/0128174 A1 6/2008 Radford et al.
2008/0257608 A1 10/2008 Fanuel et al.
2009/0242211 A1 * 10/2009 Fagley, IV ..... E21B 23/06 166/374
2010/0116556 A1 5/2010 Buske
2010/0252276 A1 10/2010 Clausen et al.
2010/0270034 A1 10/2010 Clausen
2011/0073376 A1 3/2011 Radford et al.
2011/0127044 A1 6/2011 Radford
2011/0240301 A1 10/2011 Robison
2011/0315390 A1 * 12/2011 Guillory ..... E21B 21/103 166/329
2012/0227973 A1 * 9/2012 Hart ..... E21B 21/103 166/329
2012/0261131 A1 * 10/2012 Hofman ..... E21B 34/14 166/316
2012/0305265 A1 * 12/2012 Garcia ..... E21B 34/063 166/373
2013/0081878 A1 4/2013 Wilson
2013/0092442 A1 4/2013 Zastresek et al.
2013/0133949 A1 5/2013 Xu et al.
2013/0186633 A1 * 7/2013 Kitzman ..... E21B 23/04 166/318
2013/0299199 A1 * 11/2013 Naedler ..... E21B 43/14 166/386
2015/0027725 A1 * 1/2015 Adam ..... E21B 34/14 166/373

* cited by examiner

FIG. 4A
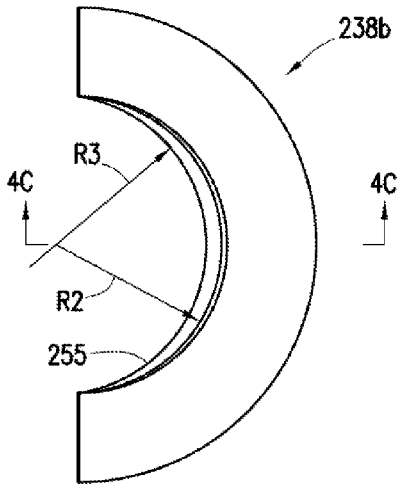
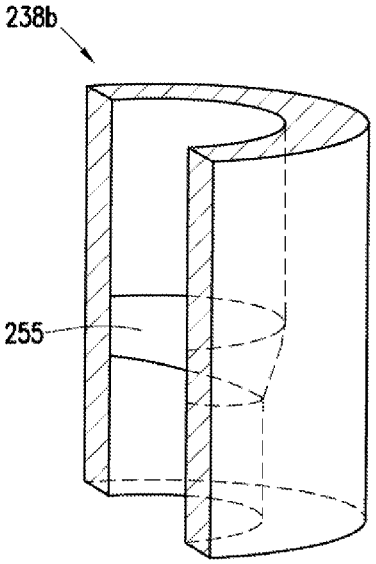
FIG. 4B
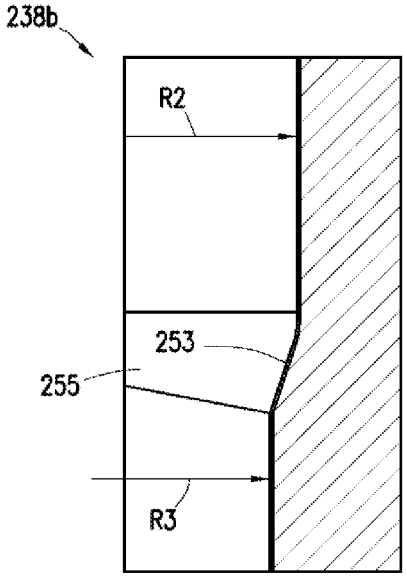
FIG. 4C

DOWNHOLE ACTIVATION ASSEMBLY WITH SLEEVE VALVE AND METHOD OF USING SAME

CROSS-REFERENCE TO RELATED APPLICATIONS

This application claims priority to U.S. Provisional Application No. 61/859,012, filed on Jul. 26, 2013.

BACKGROUND

The present disclosure relates generally to techniques for performing wellsite operations. More specifically, the present disclosure relates to downhole techniques, such as activators or activation assemblies, for use with downhole tools.

Oilfield operations may be performed to locate and gather valuable downhole fluids. Oil rigs are positioned at wellsites, and downhole equipment, such as a drilling tool, is deployed into the ground by a drill string to reach subsurface reservoirs. At the surface, an oil rig is provided to deploy stands of pipe into the wellbore to form the drill string. Various surface equipment, such as a top drive, or a Kelly, and a rotating table, may be used to apply torque to the stands of pipe, to threadedly connect the stands of pipe together, and to rotate the drill string. A drill bit is mounted on the lower end of the drill string, and advanced into the earth by the surface equipment to form a wellbore.

The drill string may be provided with various downhole components, such as a bottom hole assembly (BHA), drilling motor, measurement while drilling, logging while drilling, telemetry, reaming and/or other downhole tools, to perform various downhole operations. The downhole tool may be provided with devices for activation of downhole components. Examples of downhole tools are provided in US Patent/Application Nos. 20080128174, 20100252276, 20110073376, 20110127044, U.S. Pat. Nos. 7,252,163, 8,215,418 and 8,230,951, the entire contents of which are incorporated by reference herein.

SUMMARY

In at least one aspect, the present disclosure relates to an activation assembly for a wellsite having a wellbore penetrating a subterranean formation. The wellsite has a downhole tool deployable into the wellbore. The activation assembly includes a ball, a housing, an indexing assembly, and a sleeve valve. The housing is operatively connectable to the downhole tool, and has a housing passage for flow of fluid therethrough. The indexing assembly is positionable in the housing, includes a multiple position indexer and an indexing tube, and is operatively connectable to the downhole tool. The sleeve valve includes a fixed sleeve and a movable sleeve positionable in the housing passage of the housing and defines a ball passage therethrough. The sleeve valve has a valve seat defined therein to receive the ball such that the flow of the fluid is selectively restricted through the ball passage. The movable sleeve is engagable with the indexing tube to selectively shift the indexer between multiple positions whereby the downhole tool is selectively activatable.

The fixed sleeve and the movable sleeve may each have a hemi-cylindrical shape. The fixed sleeve may be fixedly connectable to the housing. The movable sleeve may be movably positionable in the housing in response to pressure in the housing passage. The movable sleeve and the indexing tube may be movable upon application of a force sufficient to overcome a force of a spring of the indexer. The ball may be disposable into the housing passage, through the ball passage, and through the indexing tube. The housing may be integral or modular.

The indexer may be fixedly positioned in the housing with the indexing tube extending therethrough. The indexing assembly may include a spring operatively connectable to the indexer and the housing. The indexing tube may have a tube passage therethrough in fluid communication with the housing passage. The activation assembly may also include a centralizer.

In another aspect, the disclosure relates to an activation system for a wellsite having a wellbore penetrating a subterranean formation. The activation system includes a downhole tool deployable into the wellbore by a conveyance and an activation assembly operatively connectable to the downhole tool. The activation assembly includes a ball, a housing, an indexing assembly, and a sleeve valve. The housing is operatively connectable to the downhole tool, and has a housing passage for flow of fluid therethrough. The indexing assembly is positionable in the housing, includes a multiple position indexer and an indexing tube, and is operatively connectable to the downhole tool. The sleeve valve includes a fixed sleeve and a movable sleeve positionable in the housing passage of the housing and defines a ball passage therethrough. The sleeve valve has a valve seat defined therein to receive the ball such that the flow of the fluid is selectively restricted through the ball passage. The movable sleeve is engagable with the indexing tube to selectively shift the indexer between multiple positions whereby the downhole tool is selectively activatable.

The conveyance may include a drill string. The downhole tool may include a reamer. The activation system may also include a surface pump to selectively adjust the flow of the fluid into the activation assembly.

Finally, in another aspect, the disclosure relates to a method of activating a downhole tool of a wellsite having a wellbore penetrating a subterranean formation. The method involves deploying a downhole tool into the wellbore by a conveyance. The downhole tool is operatively connectable to an activation assembly. The activation assembly includes a ball, a housing, an indexing assembly, and a sleeve valve including a fixed sleeve and a movable sleeve. The method further involves passing fluid through the activation assembly, and deploying the ball into the housing to selectively block flow of the fluid through the sleeve valve and create pressure changes sufficient to selectively advance the movable sleeve to shift the indexing assembly and the downhole tool between positions.

The method may also involve detecting the pressure changes at the surface and/or selectively adjusting the flow of the fluid form the surface. The deploying may involve passing the ball through the activation assembly, seating the ball in a ball seat of the sleeve valve, blocking the flow of the fluid through the sleeve valve with the ball to create sufficient pressure to overcome a spring force of the indexing assembly and to shift the indexing assembly to a new position, and/or increasing the flow of fluid to create sufficient pressure to drive the ball out of the ball seat and out the activation assembly.

BRIEF DESCRIPTION OF THE DRAWINGS

So that the above recited features and advantages of the present disclosure can be understood in detail, a more particular description of the invention, briefly summarized above, may be had by reference to the embodiments thereof that are illustrated in the appended drawings. The appended drawings illustrate example embodiments and are, therefore, not to be considered limiting of its scope. The figures are not necessarily to scale and certain features, and certain views of the figures may be shown exaggerated in scale or in schematic in the interest of clarity and conciseness.

FIGS. 4A-4B depict end and perspective views, respectively, of a movable sleeve of the downhole tool of FIG. 2. FIG. 4C is a cross-sectional view of the movable sleeve of FIG. 4A taken along line 4C-4C.

DETAILED DESCRIPTION

The description that follows includes exemplary apparatus, methods, techniques, and/or instruction sequences that embody aspects of the present subject matter. However, it is understood that the described embodiments may be practiced without these specific details.

The present disclosure relates to an activation assembly for remotely activating a downhole tool, such as a reamer, from the surface. The activation assembly (or stroking mechanism or stroker) may be used to shift the downhole tool between various positions. The activation assembly includes a ball, a sleeve valve including a pair of hemicylindrical sleeves (one fixed and one movable), and a multi-position indexer. The ball may be deployable into the sleeves to selectively restrict flow of fluid through the activation assembly. Pressure buildup moves the movable sleeve and the indexer to cause activation of the downhole tool. The ball then falls through the activation assembly and the activation assembly shifts to the next position.

The activation assembly is configured to define a total flow area (TFA) and a piston area (PA) therethrough. The TFA and the PA may be defined to selectively pass a ball through the activation assembly at various pressures such that the activation assembly is moved between positions. The activation assembly may house the sleeves without a seal. The sleeves may be made of a hard metal (e.g., tungsten carbide) to eliminate wash (or wear) therebetween that may result, for example, from a combination of small TFA and a turbulent flow path. The configuration may be used to provide a desired turbulent flow path and to provide sufficient pressure buildup to properly stroke the activation assembly to activate the downhole tool. The activation assembly may also be configured to provide a reduced TFA or provide complete blockage of the flow path when the ball is seated.

Figure 1:
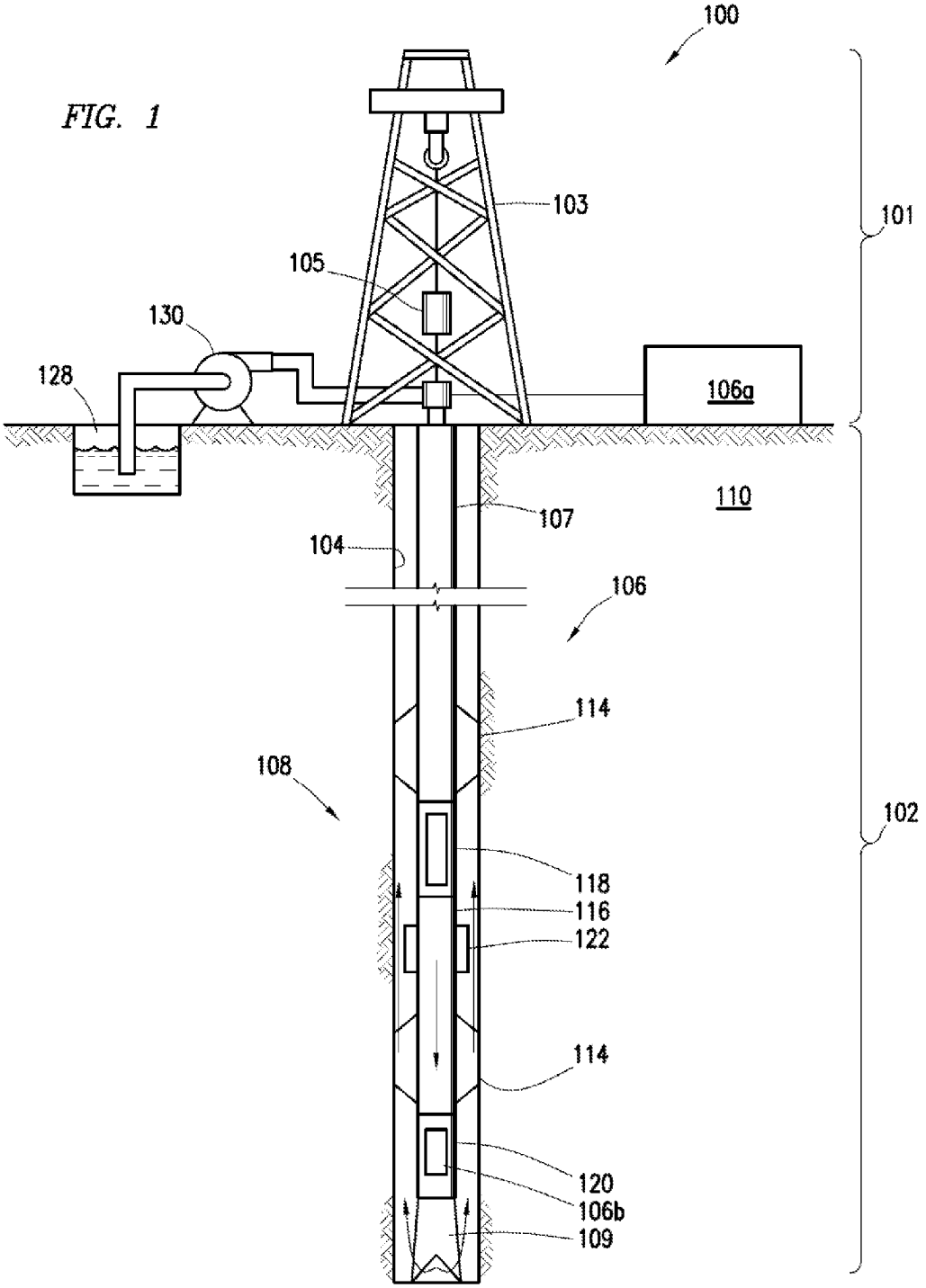
FIG. 1 depicts a schematic view, partially in cross-section of a wellsite having surface equipment and downhole equipment, the downhole equipment including a downhole activation assembly and a downhole tool.

FIG. 1 depicts a schematic view, partially in cross-section, of a wellsite 100. While a land-based drilling rig with a specific configuration is depicted, the present disclosure may involve a variety of land based or offshore applications. The wellsite 100 includes surface equipment 101 and downhole equipment 102.

The surface equipment 101 includes a rig 103 positionable at a wellbore 104 for performing various wellbore operations, such as drilling. Various rig equipment 105, such as a Kelly, rotary table, top drive, elevator, etc., may be provided at the rig 103 to operate the downhole equipment 102. A surface controller 106*a* is also provided at the surface to operate the drilling equipment.

The downhole equipment 102 includes a downhole tool 106 with a conveyance, such as drill string 107. As shown, the downhole tool 106 is a bottom hole assembly (BHA) 108 with a drill bit 109 at an end thereof. The downhole equipment 102 is advanced into a subterranean formation 110 to form the wellbore 104. The drill string 107 may include drill pipe, drill collars, coiled tubing or other tubing used in drilling operations. Downhole equipment, such as the BHA 108, is deployed from the surface and into the wellbore 104 by the drill string 107 to perform downhole operations.

The BHA 108 is at a lower end of the drill string 107 and contains various downhole equipment for performing downhole operations. As shown, the BHA 108 includes stabilizers 114, a reamer 116, an activation assembly 118, a measurement while drilling tool 120, cutter blocks 122, and a downhole controller 106*b*. While the downhole equipment is depicted as having a reamer 116 for use with the activation assembly 118, a variety of downhole tools may be activated by the activation assembly 118. The downhole equipment may also include various other equipment, such as logging while drilling, telemetry, processors and/or other downhole tools.

The stabilizers 114 may be conventional stabilizers positionable about an outer surface of the BHA 108. The reamer 116 may be an expandable reamer with extendable cutter blocks 122. The activation assembly 118 may be integral with or operatively coupled to the reamer 116 or other downhole tools for activation therein as will be described further herein. The downhole controller 106*b* provides communication between the BHA 108 and the surface controller 106*a* for the passage of power, data and/or other signals. One or more controllers 106*a,b* may be provided about the wellsite 100.

A mud pit 128 may be provided as part of the surface equipment for passing mud from the surface equipment 101 and through the downhole equipment 102, the BHA 108, and the bit 109 as indicated by the arrows. Various flow devices, such as pump 130, may be used to manipulate the flow of mud about the wellsite 100. Various tools in the BHA 108, such as the reamer 116 and the activation assembly 118, may be activated by fluid flow from the mud pit 128 and through the drill string 107.

Figure 2:
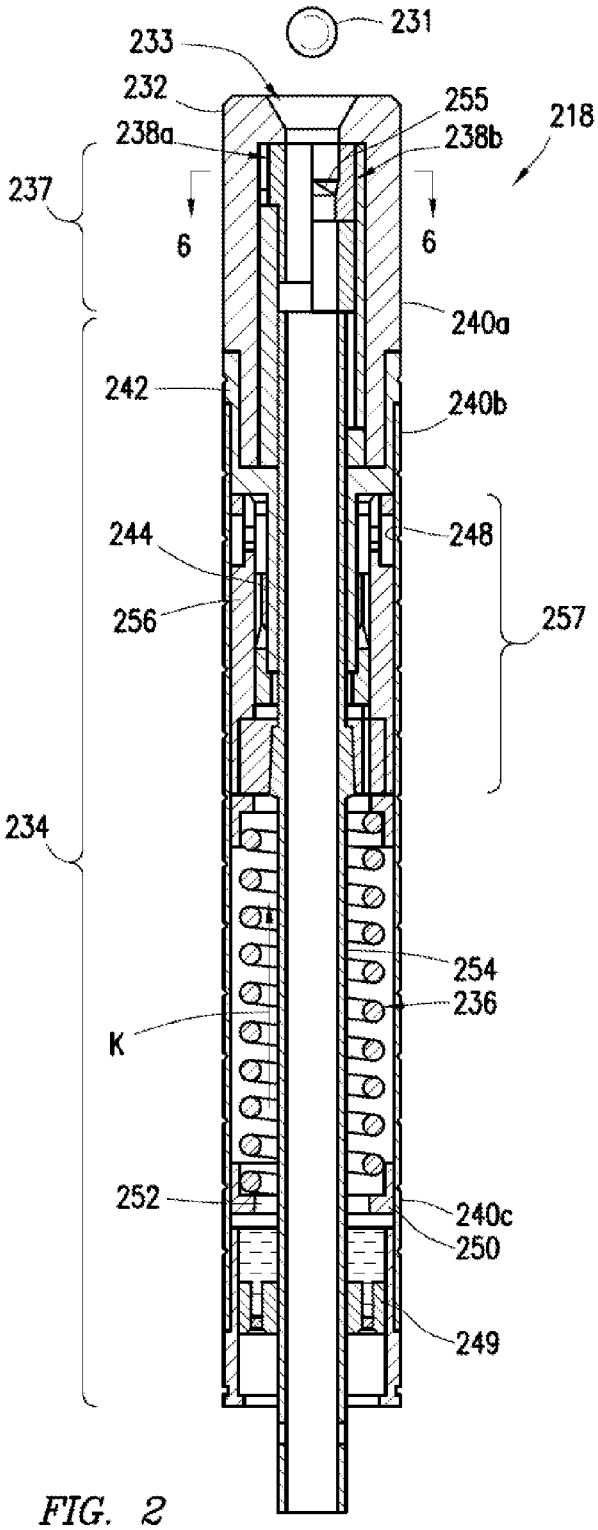
FIG. 2 depicts a longitudinal, partial cross-sectional view of a downhole activation assembly.

FIG. 2 depicts an activation assembly 218 usable as the activation assembly 118 for activating one or more downhole tools, such as reamer 116 of FIG. 1. The activation assembly 218 includes a ball 231, a housing 232, an indexing assembly 234, and a sleeve valve 237. The ball 231 is deployable into a passage (or bore) 233 extending through the housing 232 to activate one or more downhole tools. The passage 233 is configured, for example, to pass fluid, such as drilling mud from mud pit 128 therethrough, for operation of the BHA (e.g., 108 of FIG. 1).

Referring still to FIG. 2, the housing 232 may be unitary or formed of one or more portions connectable along the drill string 107 and/or BHA 108. As shown, the housing 232 includes an uphole portion 240*a*, an intermediary portion 240*b*, and a downhole portion 240*c*. The sleeve valve 237 is positioned in the uphole portion 240*a*, the indexing assembly 234 is positioned in the intermediary and downhole portions 240*b,c*.

The sleeve valve 237 includes a fixed sleeve 238*a*, and a movable sleeve 238*b* slidably positionable in the uphole portion 240*a* of the housing 232. The sleeves 238*a,b* define a seat 255 therein for receiving the ball 231. The ball 231 may be seated in the sleeve valve 237 to selectively block flow of the fluid through the passage 233.

The indexing assembly 234 is positionable in the passage 233 of the housing 232. The indexing assembly 234 includes an indexing tube 254, indexer 257, and a spring 236. The indexer 257 includes a peripheral ring 242, an inner ring 244, and an indexing sleeve 256. While an example indexer is depicted in FIG. 2, any indexer capable of translating movement of the indexing tube 254 may be used. Examples of indexers are provided in US 20100252276, previously incorporated by reference herein.

The indexing sleeve 256 is movably positionable between the inner ring 244 and the intermediary portion 240*b*. Portions of the indexer 257, such as the peripheral ring 242 may form part of the intermediary portion 240*b*. As shown, the peripheral ring 242 is operatively connectable between the uphole portion 240*a* and the downhole portion 240*c*. The inner ring 244 extends from the peripheral ring 242 a distance downhole therefrom. The index tube 254 defines a cavity 248 in the housing 232 between the intermediary portion 240*b* and the downhole portion 240*c*. Hydraulic fluid is provided in the cavity 248 and retained and sealed by a fluid compensating piston 249. The fluid compensating piston 249 allows for volumetric change of hydraulic fluid due to temperature change.

An uphole end of the indexing tube 254 of the indexing assembly 234 extends into the uphole portion 240*a* of the housing 232. The downhole portion 240*c* has a housing shoulder 250 defining a centralizer 252 therein to receive the indexing tube 254. The indexing tube 254 is supported in the downhole portion 240*c* of the housing by the centralizer 252. The indexing tube 254 is movable between an uphole position adjacent the fixed sleeve 238*a* and a downhole position a distance therefrom. The indexing tube 254 is engageable with a downhole end of the movable sleeve 238*b* and movable thereby.

The spring 236 presses against the indexer 257 to restrict downhole travel thereof. The spring 236 may be a restraining (or compressible) spring positioned in the housing 232 about the downhole portion 240*c*. The spring 236 is also positioned in the housing 232 between the indexer 257 and a housing shoulder 250. The spring 236 is compressed as the indexing tube 254 is advanced downhole.

A spring force K of the spring 236 urges the indexing tube 254 to an uphole position, as indicated by the arrow, until overcome by a downhole force. As force is applied to the movable sleeve 238*b*, the force K of spring 236 may be overcome to shift the indexing tube 254 downhole and shift the indexer 257 to a new position. The hydraulically induced stroking force of the movable sleeve 238*b* may selectively actuate the indexer 257 into an intended mode of operation. Pressure build up above the sleeve valve 237 is defined by TFA therethrough, and may be used to apply a stroking force through the sleeves 238*a,b* and to the indexing assembly 234.

Figure 3:
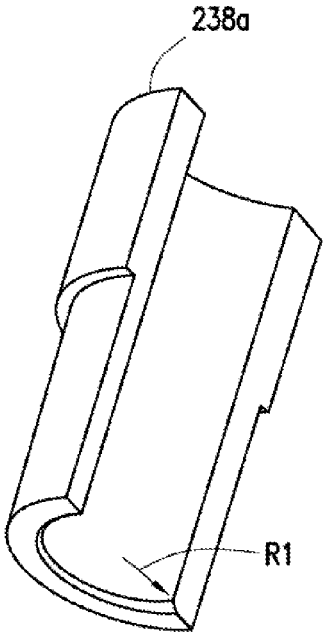
FIG. 3 depicts a perspective view of a fixed sleeve of the downhole activation assembly of FIG. 2.

FIG. 3 shows a perspective view of the fixed sleeve 238*a*. As shown in this view, the fixed sleeve 238*a* has a hemi-cylindrical shape forming half of a tubular shape. The fixed sleeve 238*a* has a constant inner radius R1. An outer surface of the fixed sleeve 238*a* may be stepped to correspond to an inner surface of the uphole portion 240*a* of the housing 232 to prevent axial movement thereof.

FIGS. 4A and 4B show an end and perspective views, respectively, of the movable sleeve 238*b*. FIG. 4C is a cross-sectional view of the movable sleeve 238*b* of FIG. 4A taken along line 4C-4C. As shown in these figures, the movable sleeve 238*b* also has a hemi-cylindrical shape forming half of a tubular. The sleeve 238*b* has a tapered inner surface defining a radius R2 along an uphole portion and defining a radius R3 along a downhole portion, with a sloped portion therebetween defining the seat 255 for receiving the ball 231. Radii R3 and R2 may define a passage for receiving the ball 231 therethrough. The passage may be of equal size along the radii R2 and R3, and the radius R3 has an offset axis from that of radius R2 such that R2=R3.

As also shown by FIG. 4C, the sleeve 238*b* may be provided with other features, such as a coating 253 (e.g. tungsten carbide). The coating 253 may be applied, for example, at the seat 255 to prevent wear and/or erosion. Coatings may also be provided at various locations about the activation assembly 218, such as along the passage 233 or areas that contact the ball 231.

Referring to FIGS. 2-4C, sleeve 238*a* is a fixed sleeve and sleeve 238*b* is a movable sleeve slidably positionable in the housing 232 uphole from the indexing assembly 234. As demonstrated by these figures, the activation assembly 218 may be used to restrict the TFA through the activation assembly 218 with the halt 231 seated within the ball seat 255. The tight fit of the ball 231 within the sleeves 238*a,b* and the sleeves 238*a,b* in the housing 232 may be used to provide tight tolerance control over the TFA and prevent wash therethrough.

The sleeves 238*a,b* are positionable in the passage 233 such that a portion of the sleeves 238*a,b* forms a tubular (or cylindrical) shape. The sleeves 238*a,b* may be of any shape, such as hemi-cylindrical (or partial) tubulars that are complementary portions forming a tubular shape. The movable sleeve 238*a* may be shorter than the fixed sleeve 238*a* and slidably movable adjacent thereto such that the tubular shape shifts with axial movement of the movable sleeve 238*b* relative to fixed sleeve 238*a*.

Downhole ends of the sleeves 238*a,b* are engageable with an uphole end of the indexing tube 254. The movable sleeve 238*b* is movable between an uphole position adjacent an uphole end of the uphole portion 240*a* of the housing 232 and a distance therefrom. The movable sleeve 238*b* is movable downhole by force applied by ball 231 as it is seated in seat 255, and pressure buildup caused thereby. The movable sleeve 238*b* is engageable with the indexing tube 254 to advance the indexing tube 254 downhole therewith.

Figure 5A:
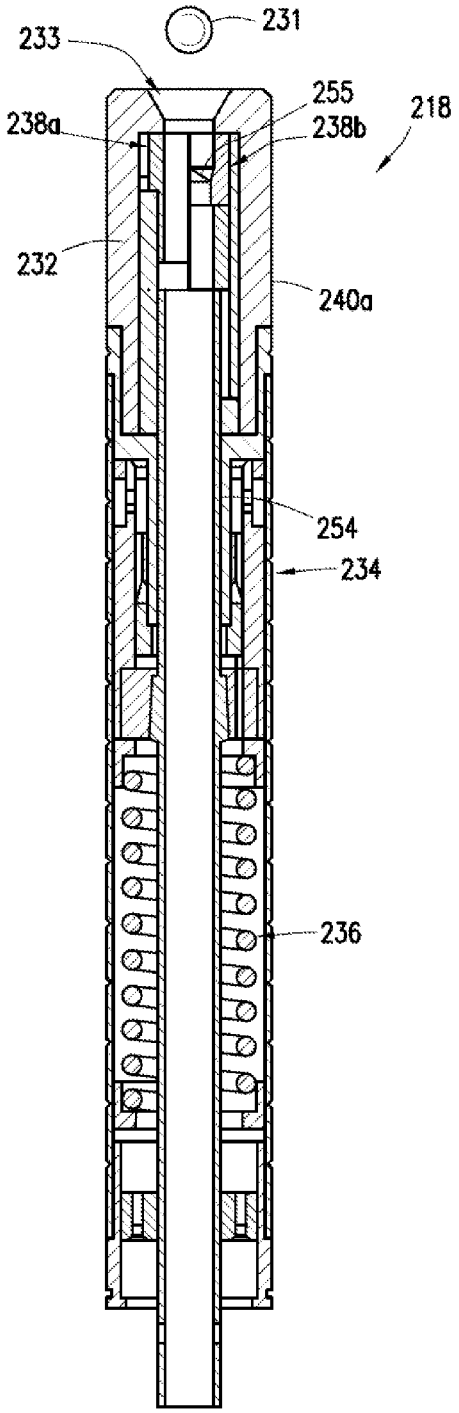
FIGS. 5A-5D depict longitudinal, cross-sectional views of the activation assembly of FIG. 2 in various stages of operation.
Figure 5B:
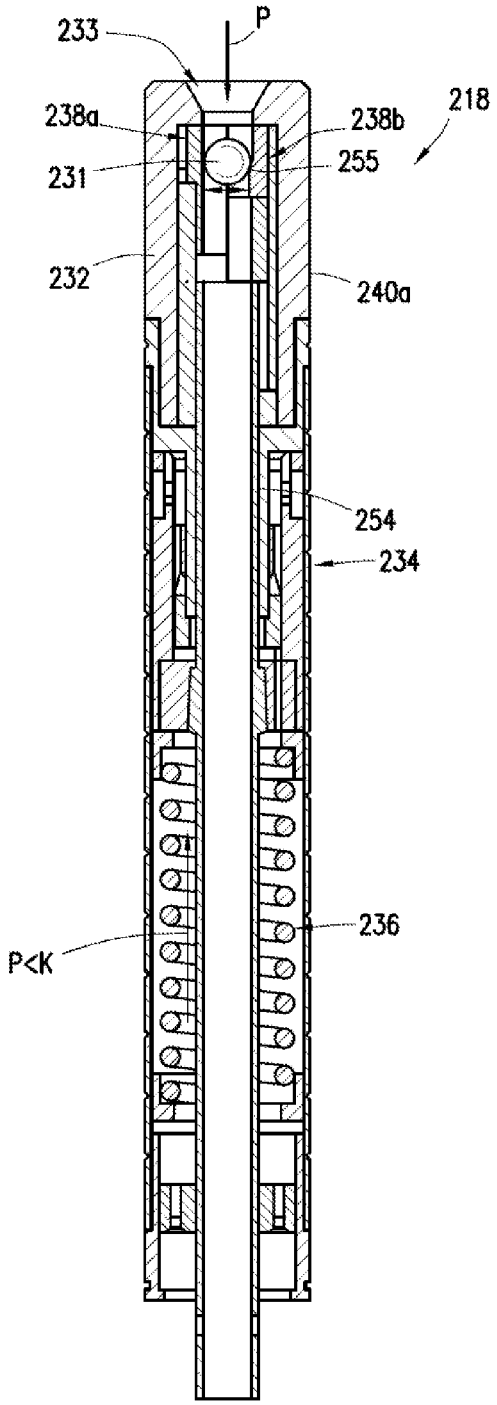
Figure 5C:
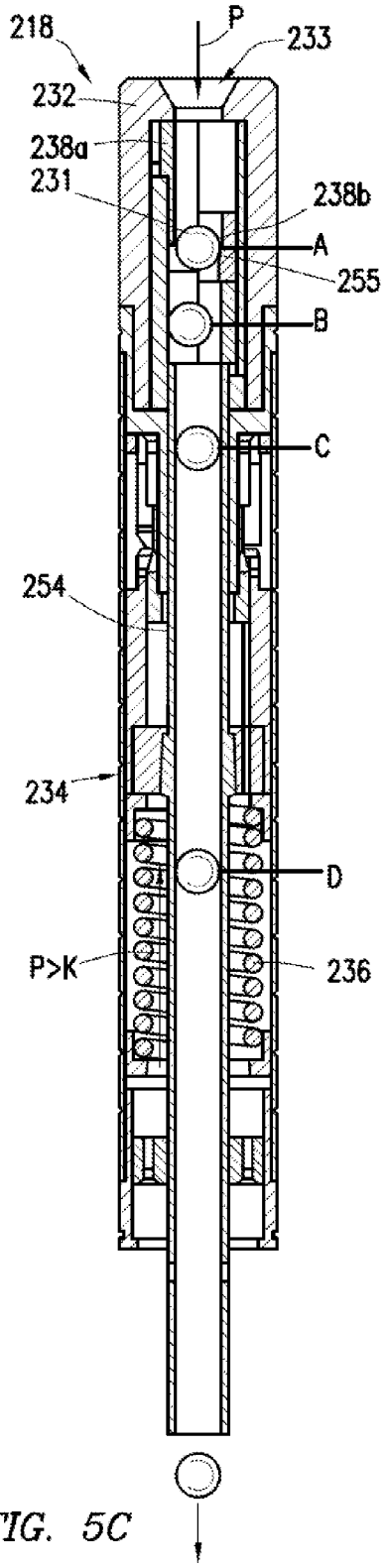
Figure 5D:
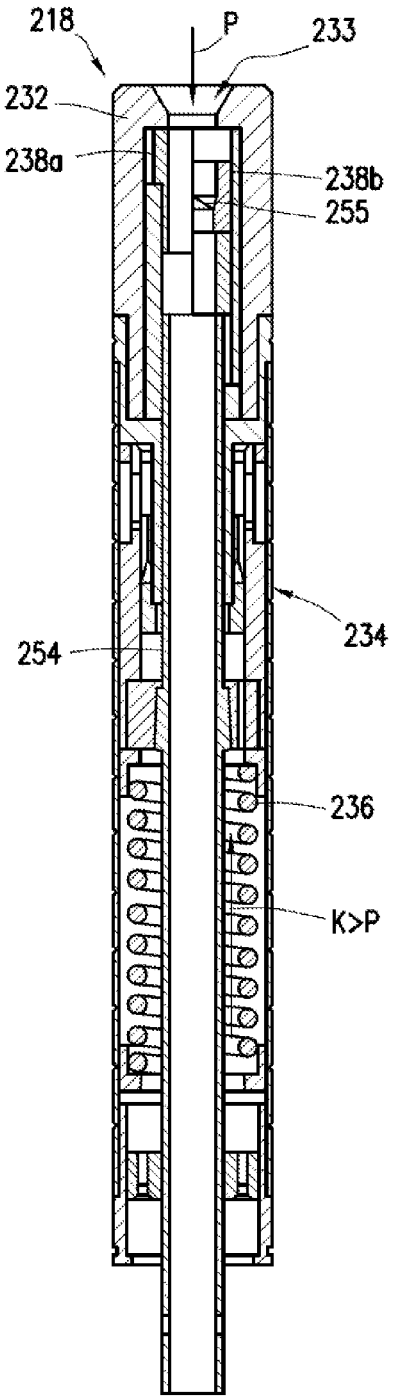

FIGS. 5A-5D depict the activation assembly 218 in various stages of operation. FIG. 5A shows the activation assembly 218 in a pre-activation position with the ball 231 preparing to deploy. FIG. 5B shows the activation assembly 218 in the pre-activation position with the ball 231 deployed therein. FIG. 5C shows the activation assembly 218 with ball passing therethrough and the indexing assembly 234 shifted to the next position. FIG. 5D shows the activation assembly 218 shifted to a new position after the ball 231 has passed through the indexing assembly 234.

As shown in FIG. 5A, the ball 231 is preparing to deploy into the activation assembly 218. The activation assembly 218 is in a deactivated position with the movable sleeve 238*b* in the uphole position adjacent an uphole end of the uphole portion 240*a* of the housing 232. The indexing tube 254 is urged into the uphole position adjacent the movable sleeve 238*b* by the spring 236.

As shown in FIG. 5B, when it is desired to activate a downhole tool, the ball 231 is deployed into the passage 233 and received between the sleeves 238*a,b*. The ball 231 is seated in the seat 255 and blocks flow of fluid through the passage 233. The ball 231 may be used to restrict the flow through the passage 233 thereby altering the total flow area (TFA) through the passage.

When seated, the ball 231 creates a buildup of pressure P uphole therefrom as fluid flows into the activation assembly 218, and is blocked by the ball 231. In the position of FIG. 5B, the ball 231 restricts or plugs off flow through the passage 233. Drilling fluid flowing through the restricted passage increases the pressure P uphole from the ball. In this position, the pressure P is insufficient to overcome the force of spring K (P<K), and the activation assembly 218 remains in the pre-activated position. The ball 231 remains in the seat 255 where an inner diameter between the sleeves 238*a,b* is smaller than a diameter of the ball 231 thereby preventing passage of the ball 231 therethrough.

The change in pressure resulting from the placement of the ball 231 in the seat 255 is detectable at the surface. Changes in flow of fluid through the activation assembly 218 may be altered, for example, by adjusting the pump rate with pump 130. For example, the pressure P may be increased by increasing the flow rate.

As shown in FIG. 5C, the pressure P behind the ball 231 creates a force sufficient to overcome the force K of the spring 236 (P>K) and shift the activation assembly 218 to an alternate position. The ball 231 advances to the position A between fixed sleeve 238*a* and movable sleeve 238*b*. The ball 231 presses against the movable sleeve 238*b* and drives the movable sleeve 238*b* downhole. The movable sleeve 238*b* also drives the indexing tube 254 downhole to compress the spring 236. As demonstrated by FIG. 5C, powered by pressure P, the ball 231 presses against the ball seat 255 and the indexing tube 254 to compress the return spring 236 until the ball 231 passes a downhole end of the fixed sleeve 238*a*.

As the movable sleeve 238*b* advances downhole, the ball 231 passes out of the seat 255 and is advanced to a position B downhole from the fixed sleeve 238*a*. The ball 231 drops off the downhole end of the fixed sleeve 238*a* and continues through the indexing tube 254 as illustrated. The ball 231 advances from the position B to position C within indexing tube 254. The ball 231 advances further to position D and eventually out the indexing assembly 234. The ball 231 may be collected in a ball catcher (not shown) located in the BHA (e.g., 108 of FIG. 1).

As shown in FIG. 5D, once the ball 231 passes through the activation assembly 218, movement of the ball 231 through the activation assembly 218 shifts the indexing assembly 234 to the activated position. As the indexer 257 shifts position, the downhole tool connected thereto (e.g., reamer 116 of FIG. 1) is moved between positions.

With the ball 231 released from the activation assembly 218, fluid is permitted to flow freely through the passage 233. With the pressure reduced, the spring force K urges the indexing tube 254 uphole, and the activation assembly 218 may now move back uphole powered by the return spring 236. The process in FIGS. 5A-5D may be repeated to return the activation assembly 218 to its original deactivated position of FIG. 5A.

The activation assembly 218 may be positionable in one or more positions, such as the positions of FIGS. 5A-5D. The operation may be repeated as desired. The balls 231 may be stored for retrieval and reuse.

FIGS. 6A-6D depict schematic cross-sectional views of the ball 231 and the sleeves 238*a*, 238*b* in various positions. These figures also depict a hydraulic piston area PA1-4 (shown shaded) defined by the sleeve 238*a* and ball 231. The piston area PA1-4 may be altered by the shape of the sleeves and the position of the ball 231 therein. The effective combined total area of sleeve 238*a* and ball 231 acts as a hydraulic piston driving the activation assembly to a downhole position.

FIGS. 6A-6D also depict a total flow area TFA1-4 (shown in white within the shaded areas defined by the sleeves and ball) of fluid flowing through the valves 238*a,b*. The TFA1-4 may be large and produce minimal pressure build up above the sleeves 238*a,b*, or small and produce a large pressure build up above the sleeves 238*a,b*. The TFA1-4 may be completely blocked and produce an extremely large pressure build up above the sleeves 238*a,b*.

Figure 6B:
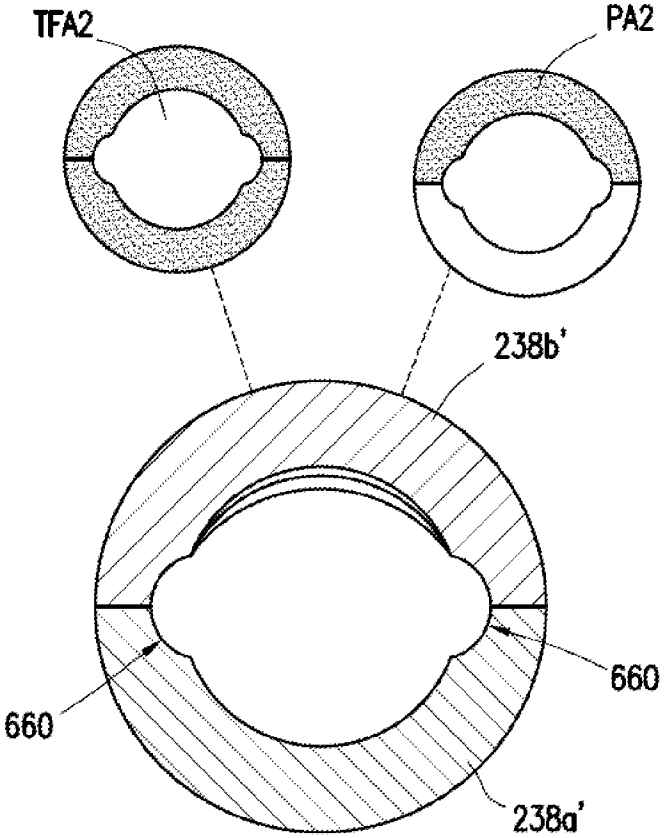
FIGS. 6A-6D depict cross-sectional views of the activation assembly of FIG. 2 taken along line 6-6 with the ball and sleeves in various positions.
Figure 6A:
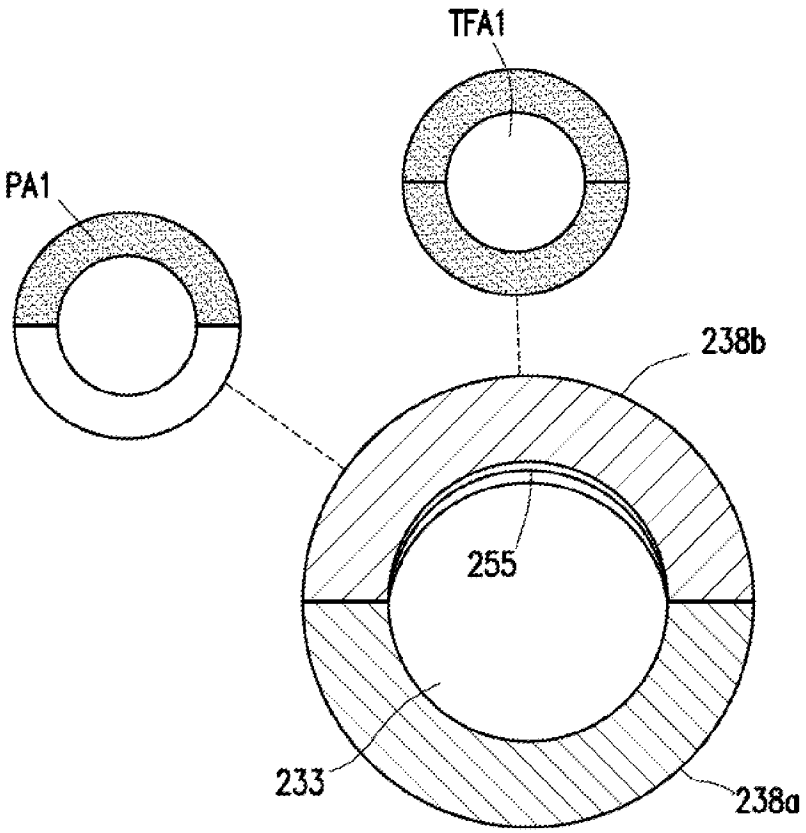

As shown in FIG. 6A, the sleeves 238*a*, 238*b* are shown without ball 231 therein. The piston area PA1 defined by the sleeves 238*a,b* is schematically depicted as having a hemi-cylindrical shape. Without ball 231 present, flow is permitted through passage 233, and pressure buildup through TFA1 across PA1 is relatively small, thus defining a relatively small piston force.

In FIG. 6B, the sleeves 238*a*', 238*b*' are shown with no ball therein. The sleeves 238*a* and 238*b* are provided with cutout portions along an inner diameter thereof to define the bypasses 660. The sleeves 238*a',b'* define the total flow area TFA2 and the piston area PA2. The piston area PA2 is schematically depicted as having a hemi-cylindrical shape with the additional bypass area. With flow permitted through passage 233, the pressure build through TFA2 and across PA2 is relatively small, thus defining a smaller piston force than in FIG. 6A.

Figure 6D:
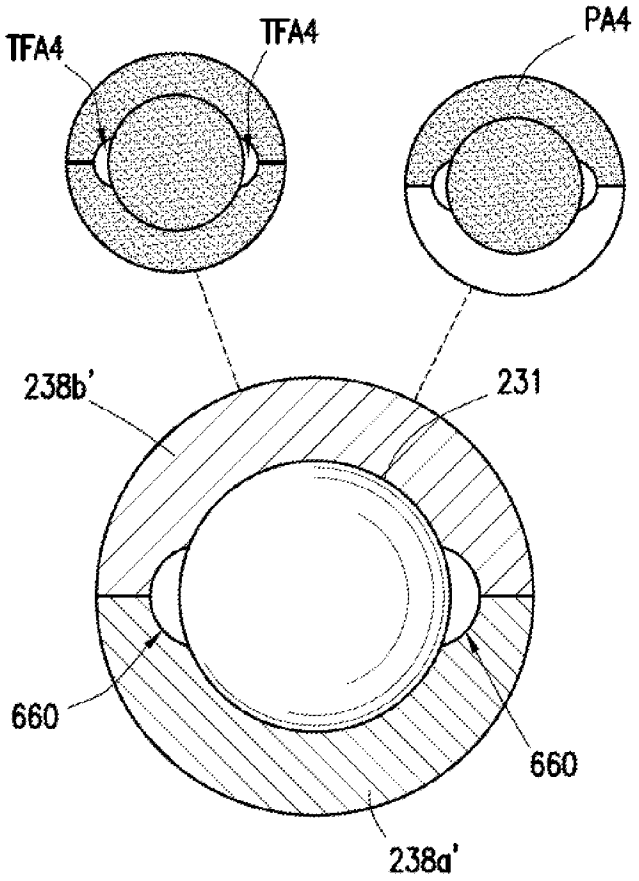
Figure 6C:
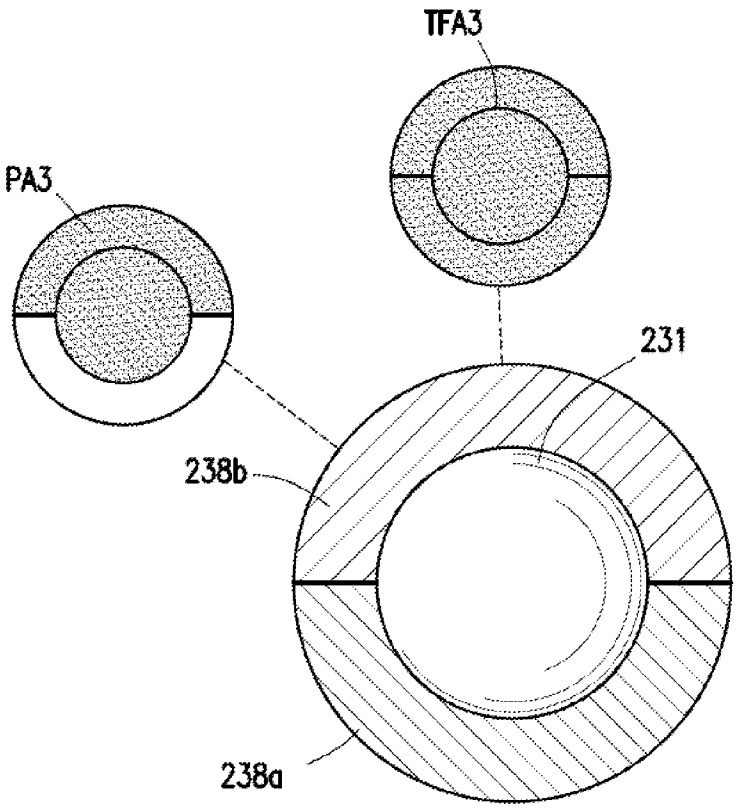

FIG. 6C shows the sleeves 238*a*, 238*b* of FIG. 6A with the ball 231 seated in seat 255. A piston area PA3 is defined as a combination of the hemi-cylindrical shape sleeve 238*b* plus circular (spherical) shape 231 ball. In this example, the TFA3 is blocked such that a large pressure build up is provided above the sleeves 238*a,b*, thus defining a large piston force.

FIG. 6D shows the sleeves 238*a',b'* with the ball 231 therein. In this case, the effective piston area PA4 is defined as a combination of hemi-cylindrical shape sleeve 238*b*minus the additional bypass area 660 plus the circular (spherical) shaped ball 231. Fluid flow TFA4 is restricted, thereby providing a large pressure build up above PA4 defining a larger piston force than in FIG. 6B and less than FIG. 6C. With this configuration, a large piston force is provided whilst still permitting flow through to continue therethrough.

The sleeves 238*a*', 238*b*' may have one or more additional bypasses 660 to permit fluid flow even when the ball 231 is seated. Fluid is permitted to flow through the bypasses 660 even when the ball 231 is seated. The bypasses 660 provide a restricted bypass area that allows drilling fluid to bypass the seated ball 231 and still generate pressure uphole from the valves 238*a',b'* and the ball 231. The shape and size of the bypasses 660 may be configured to define the amount of flow therethrough, and therefore the pressure, when the ball 231 is seated. The bypass 660 may be configured to reduce the amount of pressure when the ball 231 is seated. The PA can also be designed such that the pressure generated above the seated ball can be controlled such that a specific flow rate is required to compress the spring 236.

Figure 7:
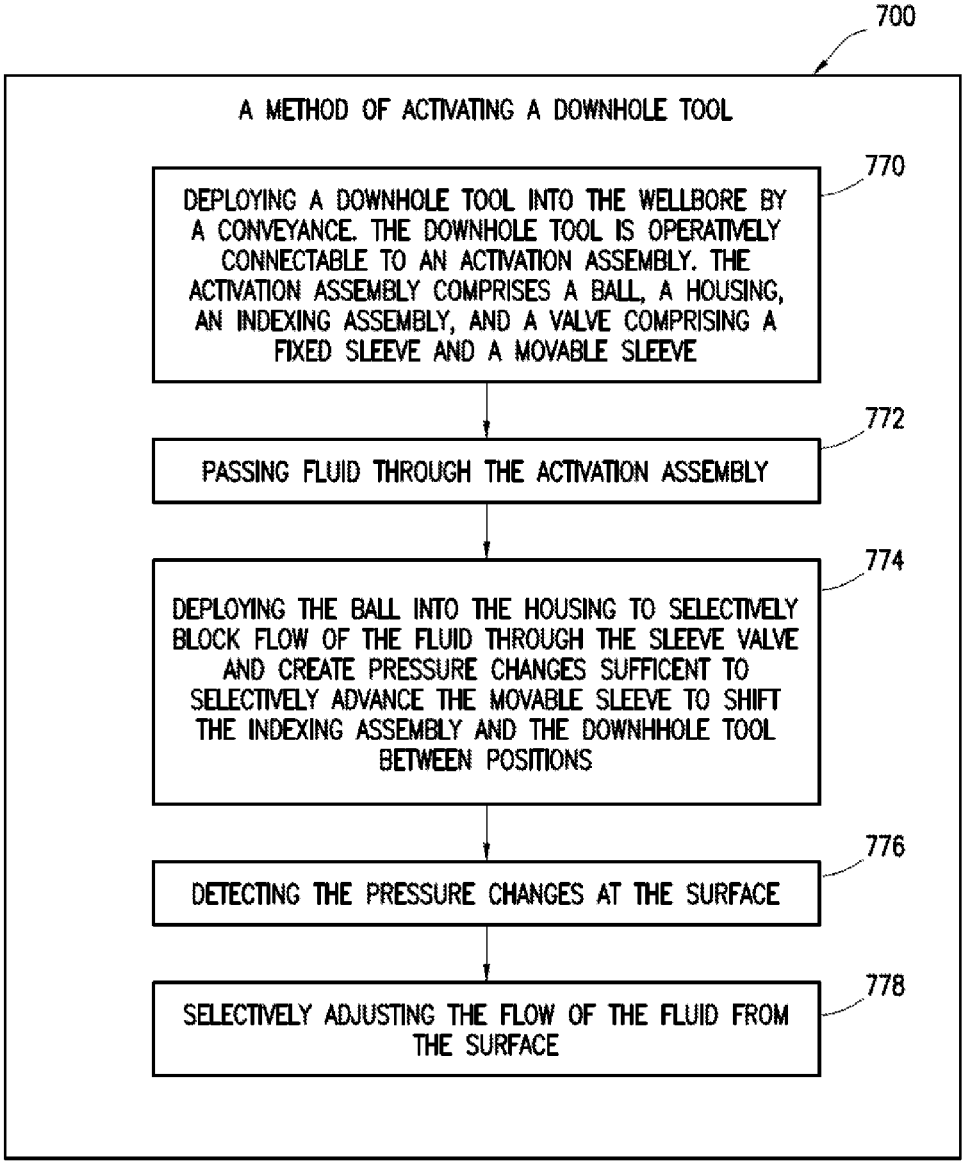
FIG. 7 is a flow chart depicting a method of activating a downhole tool.

FIG. 7 is a flow chart depicting a method 700 of activating a downhole tool. The method involves 770—deploying a downhole tool into the wellbore by a conveyance. The downhole tool is operatively connectable to an activation assembly. The activation assembly includes a ball, a housing, an indexing assembly, and a sleeve valve including a fixed sleeve and a movable sleeve. The method 700 also involves 772—passing fluid through the activation assembly, and 774—selectively shifting the indexing assembly by deploying the ball into the housing to selectively block flow of the fluid through the sleeve valve and create pressure changes to selectively advance the movable sleeve against the indexing assembly and move the indexing assembly and the downhole tool between positions.

The method 700 may also involve 776—detecting pressure changes at the surface, and 778—selectively adjusting the flow of the fluid from the surface. The method may be performed in any order, and repeated as desired. Some portions of the method may be optional.

It will be appreciated by those skilled in the art that the techniques disclosed herein can be implemented for automated/autonomous applications via software configured with algorithms to perform the desired functions. These aspects can be implemented by programming one or more suitable general-purpose computers having appropriate hardware. The programming may be accomplished through the use of one or more program storage devices readable by the processor(s) and encoding one or more programs of instructions executable by the computer for performing the operations described herein. The program storage device may take the form of, e.g., one or more floppy disks; a CD ROM or other optical disk; a read-only memory chip (ROM); and other forms of the kind well known in the art or subsequently developed. The program of instructions may be "object code," i.e., in binary form that is executable more-or-less directly by the computer; in "source code" that requires compilation or interpretation before execution; or in some intermediate form such as partially compiled code. The precise forms of the program storage device and of the encoding of instructions are immaterial here. Aspects of the invention may also be configured to perform the described functions (via appropriate hardware/software) solely on site and/or remotely controlled via an extended communication (e.g., wireless, internet, satellite, etc.) network.

While the embodiments are described with reference to various implementations and exploitations, it will be understood that these embodiments are illustrative and that the scope of the inventive subject matter is not limited to them. Many variations, modifications, additions and improvements are possible. For example, one or more activation assemblies and/or portions thereof may be provided with one or more features as provided herein and connected about the drilling system.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

What is claimed is:

1. An activation assembly for a wellsite having a wellbore penetrating a subterranean formation, the wellsite having a downhole tool deployable into the wellbore, the activation assembly comprising:

a ball;

a housing operatively connectable to the downhole tool, the housing having a housing passage for flow of fluid therethrough;

an indexing assembly positionable in the housing, the indexing assembly comprising a multiple position indexer and an indexing tube, the indexing assembly operatively connectable to the downhole tool; and a sleeve valve comprising a multi-portion tubular sleeve having a fixed sleeve portion and a movable sleeve portion positionable in the housing passage of the housing and defining a ball passage therethrough, the sleeve valve having a valve seat defined therein to receive the ball such that the flow of the fluid is selectively restricted through the ball passage, the fixed sleeve portion fixed relative to the housing and the movable sleeve portion moveable relative to the housing and engagable with the indexing tube to selectively shift the indexer between multiple positions whereby the downhole tool is selectively activatable; and wherein each of the fixed sleeve portion and the movable sleeve portion is a partial tubular that is complementary to the other portion and that together define the multi-portion tubular sleeve.

2. The activation assembly of claim 1, wherein the fixed sleeve portion and the movable sleeve portion each have a hemi-cylindrical shape.

3. The activation assembly of claim 1, wherein the fixed sleeve portion is fixedly connectable to the housing;

wherein the movable sleeve portion is movably positionable in the housing; and wherein the movable sleeve portion and the indexing tube are movable upon application of a force sufficient to overcome a force of a spring of the indexing assembly.

4. The activation assembly of claim 1, wherein the ball is disposable into the housing passage, through the ball passage, and through the indexing tube.

5. The activation assembly of claim 1, wherein the indexer is fixedly positioned in the housing with the indexing tube extending therethrough;

wherein the indexing assembly comprises a spring operatively connectable to the indexer and the housing; and wherein the indexing tube has a tube passage therethrough in fluid communication with the housing passage.

6. The activation assembly of claim 1, wherein the movable sleeve portion comprises:

an uphole cylindrical surface extending from an uphole end of the movable sleeve portion and having a radius R2;

a downhole cylindrical surface extending from a downhole end of the movable sleeve portion and having a radius R3; and a sloped surface extending between the uphole cylindrical surface and the downhole cylindrical surface, wherein the sloped surface defines the valve seat.

7. The activation assembly of claim 6, wherein the radius R2 is equal to the radius R3, wherein the radius R2 is measured from a first axis of the movable sleeve portion, and wherein the radius R3 is measured from a second axis that is parallel to and radially offset from the first axis.

8. The activation assembly of claim 1, wherein an axial length of the movable sleeve portion is smaller than an axial length of the fixed sleeve portion.

9. The activation assembly of claim 1, wherein the ball passage includes one or more bypasses that are configured to allow fluid to flow past the ball when the ball is seated on the valve seat.

10. The activation assembly of claim 9, wherein each of the fixed sleeve portion and the movable sleeve portion comprises the one or more bypasses.

11. An activation system for a wellsite having a wellbore penetrating a subterranean formation, the activation system comprising:

a downhole tool deployable into the wellbore by a conveyance; and an activation assembly operatively connectable to the downhole tool, comprising:

a ball;

a housing operatively connectable to the downhole tool, the housing having a housing passage for flow of fluid therethrough;

an indexing assembly positionable in the housing, the indexing assembly comprising a multiple position indexer and an indexing tube, the indexing assembly operatively connectable to the downhole tool; and a sleeve valve comprising:

a multi-portion tubular sleeve disposed within the housing passage at a location axially spaced from the indexing tube and comprising a fixed sleeve portion that is fixed relative to the housing and a movable sleeve portion, wherein each of the fixed sleeve portion and the movable sleeve portion is a partial tubular that is complementary to the other portion of the tubular sleeve and that together define the multi-portion tubular sleeve;

a ball passage extending through the tubular sleeve; and a valve seat within the ball passage configured to receive the ball such that the flow of the fluid is selectively restricted through the ball passage;

wherein the movable sleeve portion is moveable relative to the housing and engageable with the indexing tube and is configured to translate axially relative to the fixed sleeve portion to selectively shift the indexer between multiple positions and thereby selectively activate the downhole tool.

12. The activation system of claim 11, wherein the conveyance comprises a drill string;

wherein the downhole tool comprises a reamer; and wherein the activation system further comprises a surface pump to selectively adjust the flow of the fluid into the activation assembly.

13. The activation system of claim 11, wherein the movable sleeve portion comprises:

an uphole cylindrical surface extending from an uphole end of the movable sleeve portion and having a radius R2;

a downhole cylindrical surface extending from a downhole end of the movable sleeve portion and having a radius R3; and a sloped surface extending between the uphole cylindrical surface and the downhole cylindrical surface, wherein the sloped surface defines the valve seat.

14. The activation system of claim 13, wherein the radius R2 is equal to the radius R3, wherein the radius R2 is measured from a first axis of the movable sleeve portion, and wherein the radius R3 is measured from a second axis that is parallel to and radially offset from the first axis.

15. The activation system of claim 11, wherein an axial length of the movable sleeve portion is smaller than an axial length of the fixed sleeve portion.

16. The activation system of claim 11, wherein the ball passage includes one or more bypasses that are configured to allow fluid to flow past the ball when the ball is seated on the valve seat.

17. The activation system of claim 16, wherein each of the fixed sleeve portion and the movable sleeve portion comprises the one or more bypasses.

18. A sleeve valve for an activation assembly configured to actuate a downhole tool, the sleeve valve comprising:

a multi-portion tubular sleeve configured to be disposed within a housing passage of the activation assembly;

wherein the multi-portion tubular sleeve comprises a fixed sleeve portion that is fixed relative to the housing passage and a movable sleeve portion that is moveable relative to the housing passage and wherein each of the fixed sleeve portion and the movable sleeve portion is a partial tubular that is complementary to the other portion of the tubular sleeve;

a ball passage extending through the tubular sleeve; and a valve seat within the ball passage configured to receive a ball such that a flow of fluid is selectively restricted through the ball passage;

wherein the movable sleeve portion is configured to translate axially relative to the fixed sleeve portion and comprises an end surface configured to engage an opposing end surface of an indexing tube within the activation assembly.

19. The sleeve valve of claim 18, wherein the movable sleeve portion comprises:

an uphole cylindrical surface extending from an uphole end of the movable sleeve portion and having a radius R2;

a downhole cylindrical surface extending from a downhole end of the movable sleeve portion and having a radius R3; and a sloped surface extending between the uphole cylindrical surface and the downhole cylindrical surface, wherein the sloped surface defines the valve seat.

20. The sleeve valve of claim 19, wherein the radius R2 is equal to the radius R3, wherein the radius R2 is measured from a first axis of the movable sleeve portion, and wherein the radius R3 is measured from a second axis that is parallel to and radially offset from the first axis.

21. The sleeve valve of claim 18, wherein an axial length of the movable sleeve portion is smaller than an axial length of the fixed sleeve portion.

22. The sleeve valve of claim 18, wherein the ball passage includes one or more bypasses that are configured to allow fluid to flow past the ball when the ball is seated on the valve seat.

23. The sleeve valve of claim 22, wherein each of the fixed sleeve portion and the movable sleeve portion comprises the one or more bypasses.

* * * * *